US005643081A

United States Patent [19]

Klein

[11] Patent Number: 5,643,081

[45] Date of Patent: Jul. 1, 1997

[54] VENT SCREEN AND VENT APPARATUS

[76] Inventor: James A. Klein, Rte. 1 Box 24, Miller City, Ill. 62962-9608

[21] Appl. No.: 678,236

[22] Filed: Jul. 11, 1996

[51] Int. Cl.[6] ..... F24F 13/28

[52] U.S. Cl. ..... 454/284; 55/506; 454/290

[58] Field of Search ..... 454/284, 289, 454/290, 309; 55/500, 506, 481, DIG. 37

[56] References Cited

U.S. PATENT DOCUMENTS

| | | | |
|---|---|---|---|
| 1,429,811 | 9/1922 | Tynan | 454/289 X |
| 1,544,690 | 7/1925 | Shurtleff | 55/481 |
| 1,911,851 | 5/1933 | Scholtz | 454/289 |
| 4,222,315 | 9/1980 | Weirich . | |
| 4,615,263 | 10/1986 | Titterud . | |
| 5,058,490 | 10/1991 | Sodec et al. . | |
| 5,163,871 | 11/1992 | Huibregtse et al. . | |
| 5,176,570 | 1/1993 | Liedl | 454/309 |
| 5,238,450 | 8/1993 | Rotter . | |
| 5,312,298 | 5/1994 | Myers . | |

*Primary Examiner*—Harold Joyce

[57] ABSTRACT

A vent screen and vent apparatus includes a vent duct along with an exterior grill connected to one end of the vent duct. The exterior grill includes a screen access opening. A vent screen support assembly is connected to the vent duct between the vent duct and the exterior grill. The vent screen support assembly includes a transverse screen supporting track supported by the vent duct and a longitudinal screen supporting track connected to the transverse screen support portion. A vent screen is installed through the screen access opening and is supported by the vent screen support assembly. The exterior grill includes a plurality of grill slats. An adjustable vane assembly is supported by the vent duct, and a manually operated vane adjustment handle is connected to the adjustable vane assembly for adjusting the adjustable vane assembly. The exterior grill includes a pair of long grill sides and a pair of short grill sides. In a first embodiment, the screen access opening is located in one of the pair of long grill sides. In a second embodiment, the screen access opening is located in one of the pair of short grill sides. In a third embodiment, the transverse track assembly of the vent screen support assembly is located between the manually operated vane adjustment handle and the exterior grill.

11 Claims, 4 Drawing Sheets

VENT SCREEN AND VENT APPARATUS

BACKGROUND OF THE INVENTION

1. Field of the Invention

The present invention relates generally to screening devices and, more particularly, to screening devices especially adapted for use with air vents such as used in home heating and cooling systems.

2. Description of the Prior Art

The concept of using a screen for covering a vent is well known, and the following U.S. patents disclose a number of screens for covering a number of vents: U.S. Pat. Nos. 4,222,315, 4,615,263, 5,058,490, 5,163,871, 5,238,450, and 5,312,298. More specifically, each of U.S. Pat. Nos. 4,222,315 and 5,238,450 discloses a screen associated with an attic vent. U.S. Pat. No. 4,615,263 discloses a vent for motor homes. Each of U.S. Pat. Nos. 5,058,490, 5,163,871, and 5,312,298 discloses a floor vent which has a screen.

Particular attention is directed to U.S. Pat. Nos. 5,058,490, 5,163,871, and 5,312,298 and the floor vents disclosed therein. Each of U.S. Pat. Nos. 5,058,490, 5,163,871, and 5,312,298 discloses a floor vent that has an exterior grill which covers an interior adjustable vanes. Neither the exterior grill nor the interior vanes have a mesh size that is small enough to screen out insects. In this respect, however, it would be desirable if a vent had a sufficiently small mesh size to screen out insects.

Some air vents have exterior grills and interior vanes that have a mesh size that is so large that even small mammals and reptiles can pass through the grills and vanes. To avoid such occurrences, it would be desirable if a vent had a sufficiently small mesh size to screen out small mammals and reptiles.

In central heating and air conditioning systems, a centrally located air filter is often used to filter air before it is distributed to the respective vents. Generally, each individual vent does not include an air filter. To assure added purity of air distributed through respective vents, it would be desirable if an individual vent had an individual air filter.

Still other features would be desirable in a vent screen apparatus. To protect a vent screen from damage, it would be desirable if a vent screen could be installed behind an exterior grill so that the exterior grill would serve to protect the vent screen.

Exterior grills generally have a pair of relatively long sides and a pair of relatively short sides. In this respect, it would be desirable if a vent screen could be installed behind an exterior grill by installing the vent screen by way of a relatively long side of the exterior grill. In addition, it would also be desirable if a vent screen could be installed behind an exterior grill by installing the vent screen by way of a relatively short side of the exterior grill.

A vent generally has a manually operated handle for controlling the orientation of the vanes. With some vents, it would be desirable if a vent screen were provided which permits the manually operated handle for vane control to be accessible even when the vent screen is in position behind the exterior grill. With other vents, it would be desirable if a vent screen were provided which permits the manually operated handle for vane control to be inaccessible when the vent screen is completely in position behind the exterior grill. With such a vent, the vent screen would have to be partially displaced in order to access the manually operated handle for vane control.

Thus, while the foregoing body of prior art indicates it to be well known to use vents having screens, the prior art described above does not teach or suggest a vent screen and vent apparatus which has the following combination of desirable features: (1) has a sufficiently small mesh size to screen out small mammals and reptiles; (2) has a sufficiently small mesh size to screen out insects; (3) provides an individual vent with an individual air filter; (4) provides a vent screen that is installed behind an exterior grill so that the exterior grill serves to protect the vent screen; (5) provides a vent screen which can be installed behind an exterior grill by installing the vent screen by way of a relatively long side of the exterior grill; (6) provides a vent screen which can be installed behind an exterior grill by installing the vent screen by way of a relatively short side of the exterior grill; (7) permits a manually operated handle for vane control to be accessible even when the vent screen is in position behind the exterior grill; and (8) permits a manually operated handle for vane control to be inaccessible when the vent screen is completely in position behind the exterior grill. The foregoing desired characteristics are provided by the unique vent screen and vent apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a vent screen and vent apparatus which includes a vent duct along with an exterior grill connected to one end of the vent duct. The exterior grill includes a screen access opening. A vent screen support assembly is connected to the vent duct between the vent duct and the exterior grill. The vent screen support assembly includes a transverse screen support portion supported by the vent duct and a longitudinal screen support portion connected to the transverse screen support portion. A vent screen is installed through the screen access opening and is supported by the vent screen support assembly. The exterior grill includes a plurality of grill slats. An adjustable vane assembly is supported by the vent duct, and a manually operated vane adjustment handle is connected to the adjustable vane assembly for adjusting the adjustable vane assembly. The transverse portion of the vent screen support assembly is in a form of a transverse track assembly. The longitudinal portion of the vent screen support assembly is in a form of a longitudinal track assembly. The adjustable vane assembly includes adjustable vanes and an adjustment linkage assembly for adjusting the adjustable vanes. The adjustment linkage assembly is connected to the manually operated vane adjustment handle.

The transverse track assembly of the vent screen support assembly is located between the adjustable vanes and the manually operated vane adjustment handle, and the longitudinal track assembly extends from the transverse track assembly to the screen access opening in the exterior grill. The exterior grill includes a pair of long grill sides and a pair of short grill sides. In a first embodiment of the invention, the screen access opening is located in one of the pair of long grill sides. In a second embodiment of the invention, the screen access opening is located in one of the pair of short grill sides. In a third embodiment of the invention, the transverse track assembly of the vent screen support assembly is located between the manually operated vane adjustment handle and the exterior grill.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vent screen and vent apparatus which has all of the advantages of the prior art and none of the disadvantages.

It is another object of the present invention to provide a new and improved vent screen and vent apparatus which may be easily and efficiently manufactured and marketed.

It is a further object of the present invention to provide a new and improved vent screen and vent apparatus which is of durable and reliable construction.

An even further object of the present invention is to provide a new and improved vent screen and vent apparatus which is susceptible of a low cost of manufacture with regard to both materials and labor, and which accordingly is then susceptible of low prices of sale to the consuming public, thereby making such vent screen and vent apparatus available to the buying public.

Still yet a further object of the present invention is to provide a new and improved vent screen and vent apparatus which has a sufficiently small mesh size to screen out small mammals and reptiles.

Still another object of the present invention is to provide a new and improved vent screen and vent apparatus that has a sufficiently small mesh size to screen out insects.

Yet another object of the present invention is to provide a new and improved vent screen and vent apparatus which provides an individual vent with an individual air filter.

Even another object of the present invention is to provide a new and improved vent screen and vent apparatus that provides a vent screen that is installed behind an exterior grill so that the exterior grill serves to protect the vent screen.

Still a further object of the present invention is to provide a new and improved vent screen and vent apparatus which provides a vent screen which can be installed behind an exterior grill by installing the vent screen by way of a relatively long side of the exterior grill.

Yet another object of the present invention is to provide a new and improved vent screen and vent apparatus that provides a vent screen which can be installed behind an exterior grill by installing the vent screen by way of a relatively short side of the exterior grill.

Still another object of the present invention is to provide a new and improved vent screen and vent apparatus which permits a manually operated handle for vane control to be accessible even when the vent screen is in position behind the exterior grill.

Yet another object of the present invention is to provide a new and improved vent screen and vent apparatus that permits a manually operated handle for vane control to be inaccessible when the vent screen is completely in position behind the exterior grill.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
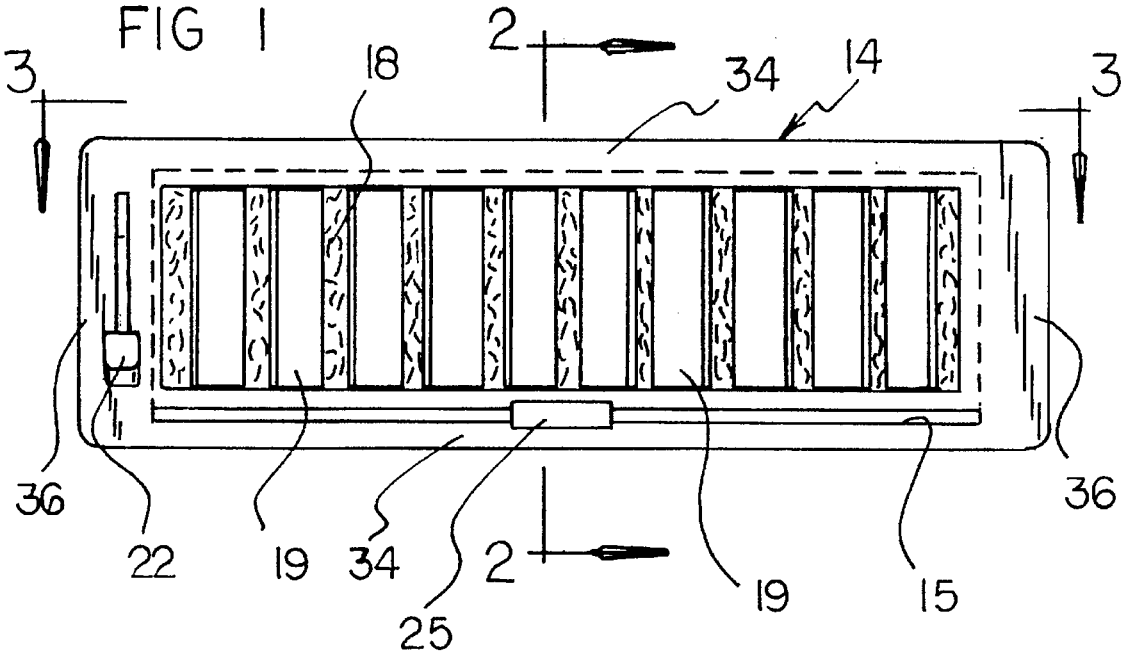
FIG. 1 is a front view showing a first embodiment of the vent screen and vent apparatus of the invention wherein a vent screen is installed behind an exterior grill by installing the vent screen by way of a relatively long side of the exterior grill.
Figure 2:
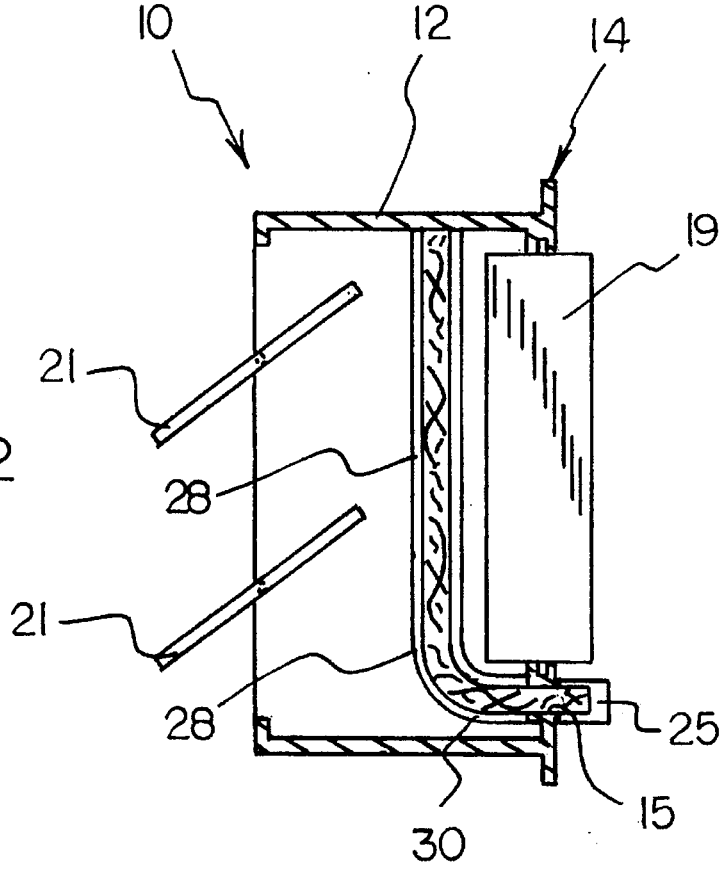
FIG. 2 is an enlarged cross-sectional view of the embodiment of the vent screen and vent apparatus shown in FIG. 1 taken along line 2—2 of FIG. 1.
Figure 3:
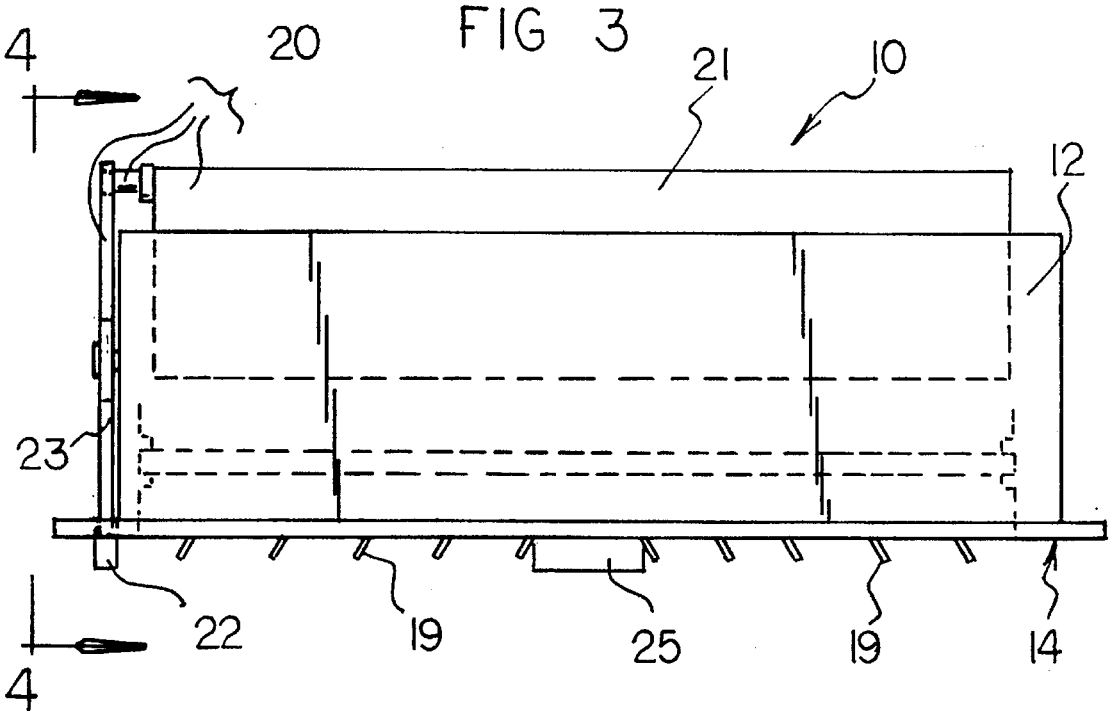
FIG. 3 is a top view of the embodiment of the vent screen and vent apparatus of FIG. 1 taken along line 3—3 thereof.
Figure 4:
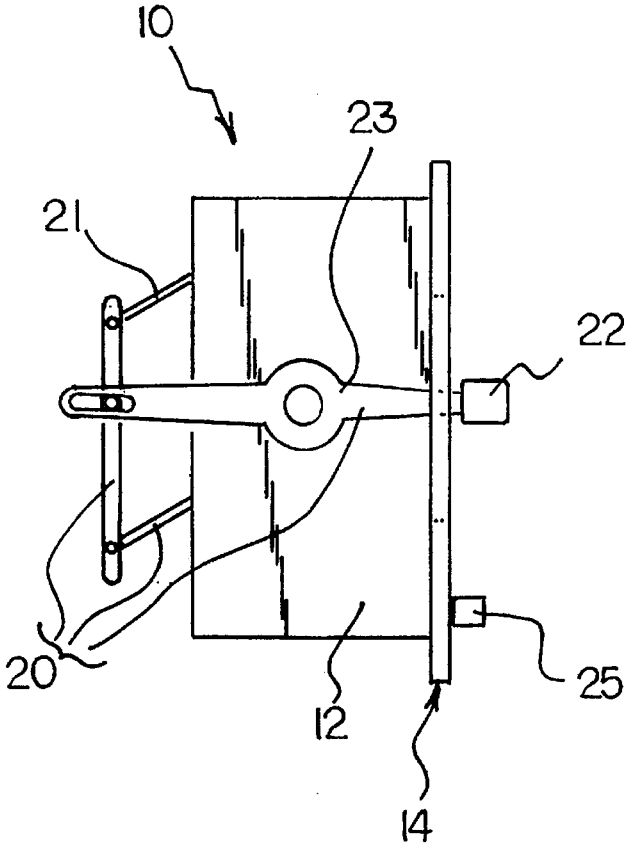
FIG. 4 is a side view of the embodiment of the invention shown in FIG. 3 taken along line 4—4 thereof.
Figure 5:
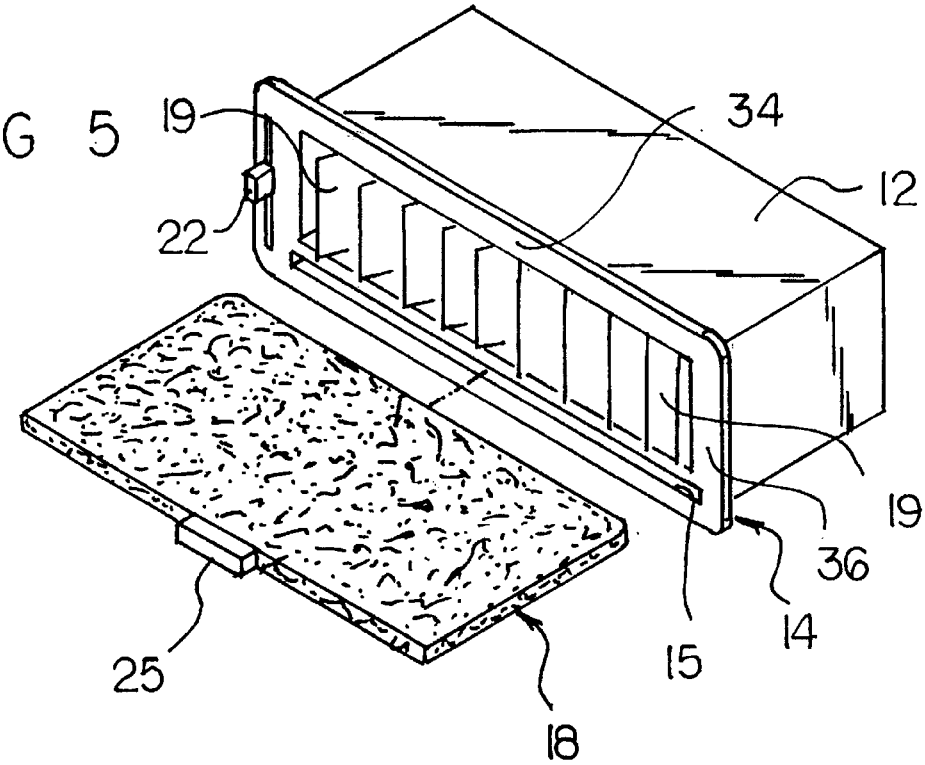
FIG. 5 is a partially exploded perspective view of the embodiment of the invention shown in FIG. 1 with the vent screen removed from the vent assembly.

With reference to the drawings, a new and improved vent screen and vent apparatus embodying the principles and concepts of the present invention will be described.

Turning to FIGS. 1–5, there is shown a first embodiment of the vent screen and vent apparatus of the invention generally designated by reference numeral 10. The vent screen and vent apparatus 10 includes a vent duct 12 along within exterior grill 14 connected to one end of the vent duct 12. The exterior grill 14 includes a screen access opening 15. A vent screen support assembly is connected to the vent duct 12 between the vent duct 12 and the exterior grill 14. The vent screen support assembly includes a transverse screen support portion supported by the vent duct 12 and a longitudinal screen support portion connected to the transverse screen support portion. A vent screen 18 is installed through the screen access opening 15 and is supported by the vent screen support assembly. The exterior grill 14 includes a plurality of grill slats 19. An adjustable vane assembly 20 is supported by the vent duct 12, and a manually operated vane adjustment handle 22 is connected to the adjustable vane assembly 20 for adjusting the adjustable vane assembly 20. The transverse portion of the vent screen support assembly is in a form of a transverse track assembly 28. The longitudinal portion of the vent screen support assembly is in a form of a longitudinal track assembly 30. The adjustable vane assembly 20 includes adjustable vanes 21 and an adjustment linkage assembly 23 for adjusting the adjustable vanes 21. The adjustment linkage assembly 23 is connected to the manually operated vane adjustment handle 22.

The transverse track assembly 28 of the vent screen support assembly is located between the adjustable vanes 21 and the manually operated vane adjustment handle 22, and the longitudinal track assembly 30 extends from the transverse track assembly 28 to the screen access opening 15 in the exterior grill 14. The exterior grill 14 includes a pair of long grill sides 34 and a pair of short grill sides 36. The screen access opening 15 is located in one of the pair of long grill sides 34.

To use the first embodiment of the invention, the vent screen 18 has a screen handle 25, and the screen handle 25 is grasped by a person for installing the vent screen 18. An edge of the vent screen 18 is inserted through the screen access opening 15 into the longitudinal track assembly 30, and the screen handle 25 is pushed towards the exterior grill 14. With the first embodiment of the invention, the screen access opening 15 is in a long grill side 34 of the exterior grill 14. As a result of pushing in the screen handle 25, the main portion of the vent screen 18 moves through the longitudinal track assembly 30 and into the transverse track assembly 28. When the vent screen 18 is fully installed, the main portion of the vent screen 18 is positioned between the exterior grill 14 and the adjustable vane assembly 20. As a result, most of the air that will pass through the exterior grill 14 into a room must first pass through the vent screen 18.

Figure 6:
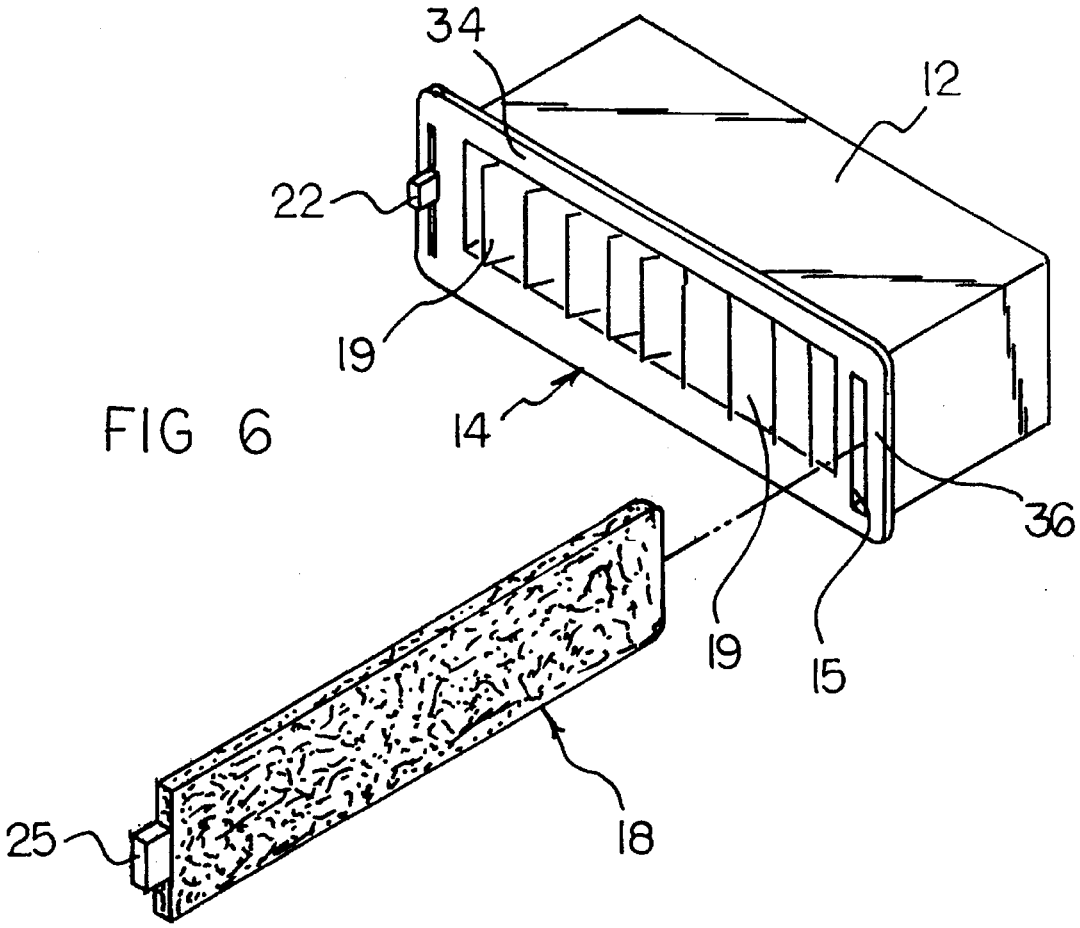
FIG. 6 is a partially exploded perspective view of a second embodiment of the invention in which a vent screen is installed behind an exterior grill by installing the vent screen by way of a relatively short side of the exterior grill.

As illustrated in FIG. 6, with a second embodiment of the vent screen and vent apparatus 10 of the invention, the screen access opening 15 is located in one of the pair of short grill sides 36. Use of the second embodiment of the invention is carded out in substantially the same way as for the first embodiment of the invention, with the exception that the screen access opening 15 is located in a short grill side 36 of the exterior grill 14.

With both the first and second embodiments of the invention, when the vent screen 18 is installed in the transverse track assembly 28 and the longitudinal track assembly 30, the manually operated vane adjustment handle 22 is accessible to a person for adjusting the adjustable vane assembly 20.

Figure 7:
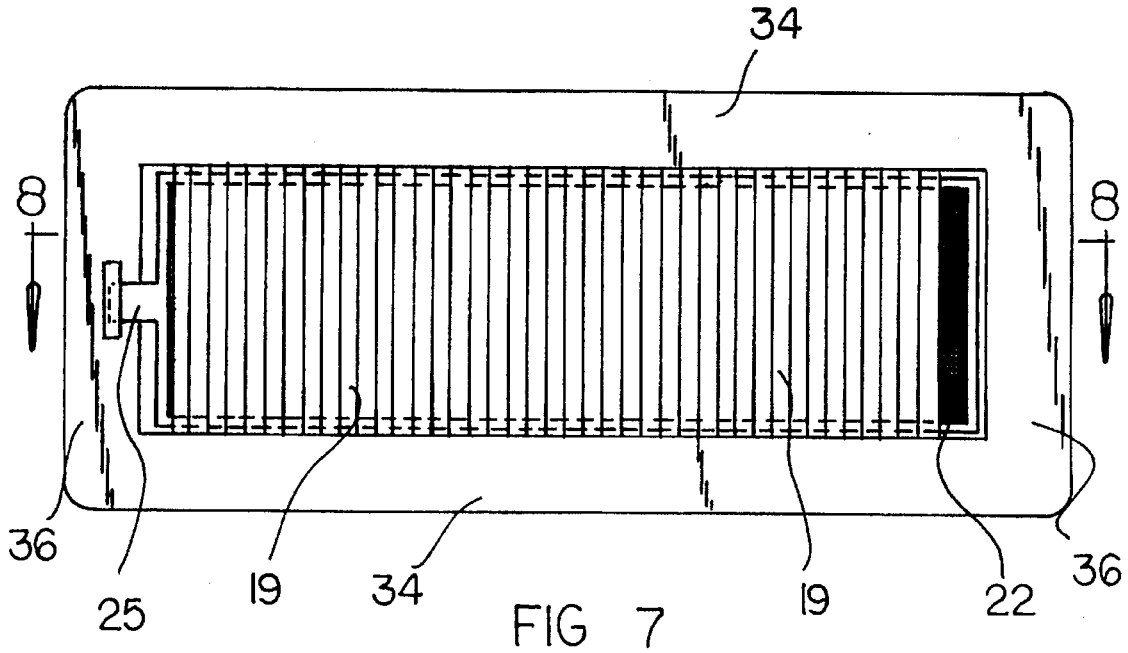
FIG. 7 is front view of a third embodiment of the invention which permits a manually operated handle for vane control to be inaccessible when the vent screen is completely in position behind the exterior grill.
Figure 8:
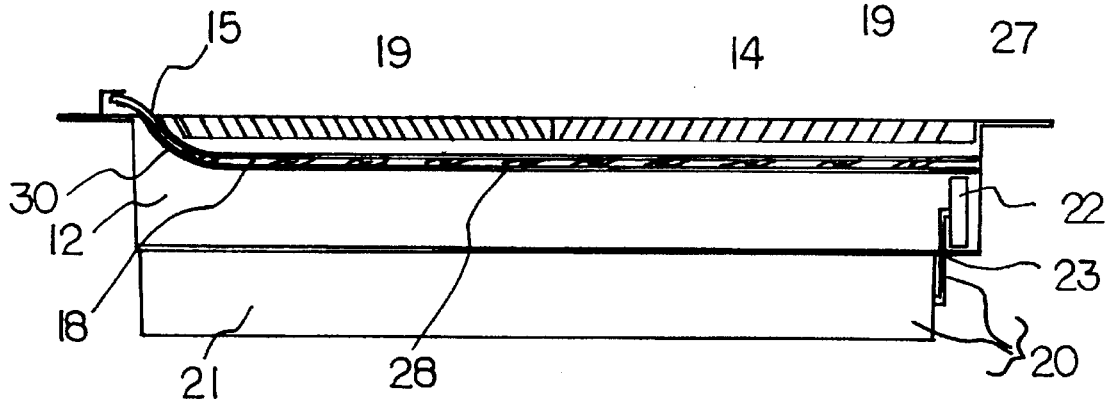
FIG. 8 is a cross-sectional view of the embodiment of the invention shown in FIG. 7 taken along line 8—8 thereof.

As illustrated in FIGS. 7 and 8, with a third embodiment of the vent screen and vent apparatus 10 of the invention, the transverse track assembly 28 of the vent screen support assembly is located between the manually operated vane adjustment handle 22 and the exterior grill 14.

With the third embodiment of the invention, the manually operated vane adjustment handle 22 cannot be used to adjust the adjustable vane assembly 20 as long as the vent screen 18 is fully installed in the transverse track assembly 28 and the longitudinal track assembly 30. To adjust the adjustable vane assembly 20, the screen handle 25 is grasped, and the vent screen 18 is partially pulled out from the transverse track assembly 28 to expose the manually operated vane adjustment handle 22. With the vent screen 18 in this position, the manually operated vane adjustment handle 22 can be operated through an access opening 27 in the exterior grill 14 to adjust the adjustable vane assembly 20. After the adjustable vane assembly 20 is adjusted, the screen handle 25 is grasped and pushed in to fully install the vent screen 18 in the transverse track assembly 28. In the fully installed position, such as shown in FIG. 8, the manually operated vane adjustment handle 22 is blocked by the vent screen 18.

The material that is used to fabricate the vent screen 18 can be selected from a wide variety of materials. More specifically, the material can be conventional screening material such as used in conventional window screens to screen out the vast majority of flying and crawling insects and other bugs. As desired, the materials composing the vent screen 18 can be reusable or disposable.

The components of the vent screen and vent apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved vent screen and vent apparatus that is low in cost, relatively simple in design and operation, and which may advantageously be used to screen out small mammals and reptiles. With the invention, a vent screen and vent apparatus is provided which has a sufficiently small mesh size to screen out insects. With the invention, a vent screen and vent apparatus provides an individual vent with an individual air filter. With the invention, a vent screen and vent apparatus provides a vent screen that is installed behind an exterior grill so that the exterior grill serves to protect the vent screen. With the invention, a vent screen and vent apparatus provides a vent screen which can be installed behind an exterior grill by installing the vent screen by way of a relatively long side of the exterior grill. With the invention, a vent screen and vent apparatus provides a vent screen which can be installed behind an exterior grill by installing the vent screen by way of a relatively short side of the exterior grill. With the invention, a vent screen and vent apparatus is provided which permits a manually operated handle for vane control to be accessible even when the vent screen is in position behind the exterior grill. With the invention, a vent screen and vent apparatus is provided which permits a manually operated handle for vane control to be inaccessible when the vent screen is completely in position behind the exterior grill.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A vent screen and vent apparatus, comprising:

a vent duct, an exterior grill connected to one end of said vent duct, wherein said exterior grill includes a screen access opening, a vent screen support assembly connected to said vent duct between said vent duct and said exterior grill, wherein said vent screen support assembly includes a transverse screen support portion supported by said vent duct and a longitudinal screen support portion connected to said transverse screen support portion, and a vent screen installed through said screen access opening and supported by said vent screen support assembly.

2. The apparatus of claim 1 wherein said exterior grill includes a plurality of grill slats.

3. The apparatus of claim 1, further including:

an adjustable vane assembly supported by said vent duct, and a manually operated vane adjustment handle connected to said adjustable vane assembly for adjusting said adjustable vane assembly.

4. The apparatus of claim 3 wherein said adjustable vane assembly includes:

adjustable vanes, and an adjustment linkage assembly for adjusting said adjustable vanes, wherein said adjustment linkage assembly is connected to said manually operated vane adjustment handle.

5. The apparatus of claim 1 wherein said transverse portion of said vent screen support assembly is in a form of a transverse track assembly.

6. The apparatus of claim 5 wherein said longitudinal portion of said vent screen support assembly is in a form of a longitudinal track assembly.

7. The apparatus of claim 6 wherein:

said transverse track assembly of said vent screen support assembly is located between said adjustable vanes and said manually operated vane adjustment handle, and said longitudinal track assembly extends from said transverse track assembly to said screen access opening in said exterior grill.

8. The apparatus of claim 7 wherein said transverse track assembly of said vent screen support assembly is located between said manually operated vane adjustment handle and said exterior grill.

9. The apparatus of claim 1 wherein said exterior grill includes a pair of long grill sides and a pair of short grill sides.

10. The apparatus of claim 9 wherein said screen access opening is located in one of said pair of long grill sides.

11. The apparatus of claim 9 wherein said screen access opening is located in one of said pair of short grill sides.

* * * * *